US009899721B2

(12) United States Patent
Morgan et al.

(10) Patent No.: US 9,899,721 B2
(45) Date of Patent: Feb. 20, 2018

(54) DIELECTRIC WAVEGUIDE COMPRISED OF A DIELECTRIC CLADDING MEMBER HAVING A CORE MEMBER AND SURROUNDED BY A JACKET MEMBER

(71) Applicants: Tyco Electronics Corporation, Berwyn, PA (US); Tyco Electronics (Shanghai) Co., Ltd., Shangahi (CN)

(72) Inventors: Chad Morgan, Carneys Point, NJ (US); Liang Huang, Chengdu (CN)

(73) Assignees: TE CONNECTIVITY CORPORATION, Berwyn, PA (US); TYCO ELECTRONICS (SHANGHAI) CO., LTD., Shanghai (CN)

( * ) Notice: Subject to any disclaimer, the term of this patent is extended or adjusted under 35 U.S.C. 154(b) by 20 days.

(21) Appl. No.: 14/832,622

(22) Filed: Aug. 21, 2015

(65) Prior Publication Data

US 2017/0040659 A1 Feb. 9, 2017

(30) Foreign Application Priority Data

Aug. 6, 2015 (CN) ..... 2015 1 0477085

(51) Int. Cl.
*H01P 3/16* (2006.01)

(52) U.S. Cl.
CPC ..... *H01P 3/16* (2013.01); *H01P 3/165* (2013.01)

(58) Field of Classification Search
CPC .... H01P 3/16; H01P 3/20; H01P 3/121; H01P 3/122

(Continued)

(56) References Cited

U.S. PATENT DOCUMENTS 4,293,833 A 10/1981 Popa
4,441,091 A * 4/1984 Nishida et al. ..... H01Q 13/20 333/236

(Continued)

FOREIGN PATENT DOCUMENTS

EP 0318198 A1 5/1989
JP S51138369 A 11/1976

OTHER PUBLICATIONS

International Search Report, International Application No. PCT/US2016/045080, dated Aug. 2, 2016.

(Continued)

*Primary Examiner* — Benny Lee

(57) ABSTRACT

A dielectric waveguide for propagating electromagnetic signals includes a cladding member and a jacket member. The cladding member extends a length between two ends. The cladding member is formed of an intermediate dielectric material. The cladding member defines a core region that extends through the cladding member along the length of the cladding member. The core region is filled with a central dielectric material having a dielectric constant value that is less than a dielectric constant value of the intermediate dielectric material of the cladding member. The jacket member engages and surrounds the cladding member along the length of the cladding member. The jacket member is formed of an outer dielectric material having a dielectric constant value that is less than the dielectric constant value of the intermediate dielectric material of the cladding member.

20 Claims, 4 Drawing Sheets

(58) Field of Classification Search
USPC ..... 333/239, 241, 242
See application file for complete search history.

(56) References Cited

U.S. PATENT DOCUMENTS

| | | | |
|---|---|---|---|
| 4,800,350 | A | 1/1989 | Bridges et al. |
| 5,889,449 | A | 3/1999 | Fiedziuszko |
| 2006/0093275 | A1 | 5/2006 | Lagace et al. |
| 2014/0240062 | A1 | 8/2014 | Herbsommer et al. |
| 2014/0285293 | A1 | 9/2014 | Schuppener et al. |
| 2014/0368301 | A1 | 12/2014 | Herbsommer et al. |
| 2017/0040658 | A1 | 2/2017 | Morgan et al. |

OTHER PUBLICATIONS

D. Pavlidis et al., "Circular Composite Dielectric Waveguides and Their Applications in HE11 Mode High Power Microwave Heating Systems", 8th European Microwave Conference 78, Jan. 1, 1978, pp. 584-588, No. 139.

Yamashita et al., "Composite Dielectric Waveguides with Two Elliptic-Cylinder Boundaries", IEEE Transactions on Microwave Theory and Techniques, Sep. 1, 1981, pp. 987-990, vol. MTT-29, No. 9, IEEE Service Center, Piscataway, US.

R. Chou et al., "Modal Attenuation in Multilayered Coated Waveguides", IEEE Transactions on Microwave Theory and Techniques, Jul. 1, 1988, pp. 1167-1176. vol. 36, No. 7, IEEE Service Center, Piscataway, US.

T. Kosugi et al., "Densely-Aligned Multi-Channel Polymer Optical Waveguide with Graded-Index Cores for Simple Implementation on Printed Circuit", Electronic Components and Technology Conference, May 26, 2009, pp. 201-206, IEEE, Piscataway, US.

F. Doany et al., "Multichannel High-Bandwith Coupling of tiltradense Silicon Photonic Waveguide Array to Standard-Pitch Fiber Array", Journal of Lightwave Technology, Feb. 1, 2011, pp. 475-482, vol. 29, No. 4, IEEE Service Center, New York, US.

* cited by examiner

DIELECTRIC WAVEGUIDE COMPRISED OF A DIELECTRIC CLADDING MEMBER HAVING A CORE MEMBER AND SURROUNDED BY A JACKET MEMBER

CROSS-REFERENCE TO RELATED APPLICATIONS

This application claims priority to Chinese Patent Application No. 201510477085.7, filed on 6 Aug. 2015, which is incorporated by reference herein in its entirety.

BACKGROUND OF THE INVENTION

The subject matter herein relates generally to dielectric waveguides.

Dielectric waveguides are used in communications applications to convey electromagnetic waves along a path between two ends. Dielectric waveguides provide communication transmission lines for connecting antennas to radio frequency transmitters and receivers and the like. Although electromagnetic waves in open space propagate in all directions, dielectric waveguides direct the electromagnetic waves along a defined path, which allows the waveguides to transmit high frequency signals over relatively long distances.

Dielectric waveguides include at least one dielectric material. A dielectric is an electrical insulating material that can be polarized by an applied electrical field. The polarizability of a dielectric material is expressed by a value called the dielectric constant or relative permittivity. The dielectric constant of a given material is its dielectric permittivity expressed as a ratio relative to the permittivity of a vacuum, which is 1 by definition. A first dielectric material with a greater dielectric constant than a second dielectric material is able to store more electrical charge by means of polarization than the second dielectric material.

Some known dielectric waveguides include a core dielectric material and a cladding dielectric material that surrounds the core dielectric material. The dielectric constants, in addition to the dimensions and other parameters, of each of the core dielectric material and the cladding dielectric material affect how an electric field through the waveguide is distributed within the waveguide. In known dielectric waveguides, the electric field is distributed through the core dielectric material, the cladding dielectric material, and even partially outside of the cladding dielectric material (for example, within the air surrounding the waveguide).

There are several issues associated with portions of the electric field extending outside of the cladding of the dielectric waveguide into the surrounding environment. First, some electric fields in air may travel faster than fields that propagate within the waveguide, which leads to the undesired electrical effect called dispersion. Dispersion occurs when some frequency components of a signal travel at a different speed than other frequency components of the signal, resulting in inter-symbol interference. Second, the portions of the electric field outside of the waveguide may produce high crosstalk levels when multiple dielectric waveguides are bundled together in a bulk cable. Third, the external portions of the electric field, including portions of the field at the outer edge of the cladding dielectric material, may experience interference and signal degradation due to external physical influences, such as a human hand touching the dielectric waveguide. Finally, portions of the electric field outside of the waveguide may be lost along bends in the waveguide, as uncontained fields tend to radiate away in a straight line instead of following the contours of the waveguide.

A need remains for a dielectric waveguide for propagating high frequency electromagnetic signals that concentrates the electric field within the waveguide, reducing the amount of the field outside of the waveguide and along the outer boundary of the waveguide.

SUMMARY OF THE INVENTION

In an embodiment, a dielectric waveguide for propagating electromagnetic signals is provided that includes a cladding member and a jacket member. The cladding member extends a length between two ends. The cladding member is formed of an intermediate dielectric material. The cladding member defines a core region that extends through the cladding member along the length of the cladding member. The core region is filled with a central dielectric material having a dielectric constant value that is less than a dielectric constant value of the intermediate dielectric material of the cladding member. The jacket member engages and surrounds the cladding member along the length of the cladding member. The jacket member is formed of an outer dielectric material having a dielectric constant value that is less than the dielectric constant value of the intermediate dielectric material of the cladding member.

In another embodiment, a dielectric waveguide for propagating electromagnetic signals is provided that includes a core member, a cladding member, and a jacket member. The core member extends a length between two ends. The core member is formed of a central dielectric material. The cladding member engages and surrounds the core member along the length of the core member. The cladding member is formed of an intermediate dielectric material having a dielectric constant value that is greater than a dielectric constant value of the central dielectric material of the core member. The jacket member engages and surrounds the cladding member along the length of the cladding member. The jacket member is formed of an outer dielectric material having a dielectric constant value that is less than the dielectric constant value of the intermediate dielectric material of the cladding member.

DETAILED DESCRIPTION OF THE INVENTION

Figure 1:
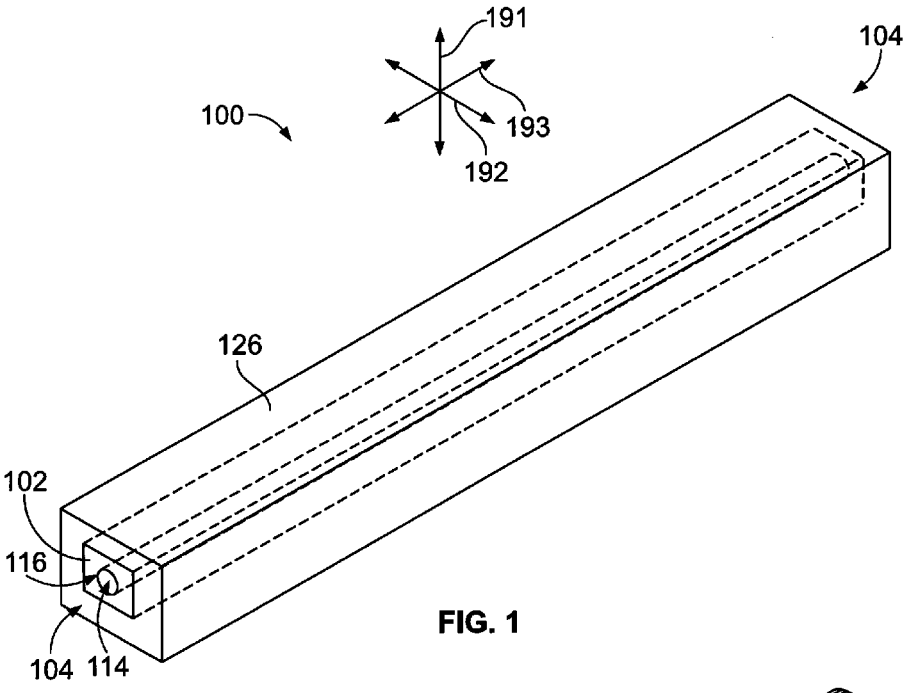
FIG. 1 is a top perspective view of a dielectric waveguide formed in accordance with an embodiment.

FIG. 1 is a top perspective view of a dielectric waveguide 100 formed in accordance with an embodiment. The dielectric waveguide 100 is configured to convey electromagnetic signals along a length of the waveguide 100 for transmission of the electromagnetic signals to or from an antenna, a radio frequency transmitter and/or receiver, or another electrical component. The electromagnetic signals may be in the form of electromagnetic waves. The dielectric waveguide 100 may be used to transmit sub-terahertz radio frequency signals, such as in the range of 120-160 GHz. The signals are millimeter-wave signals since the signals in this frequency range have wavelengths less than five millimeters. The dielectric waveguide 100 may be used to transmit modulated radio frequency (RF) signals. The modulated RF signals may be modulated in various domains to increase data throughput. The dielectric waveguide 100 is oriented with respect to a vertical or elevation axis 191, a lateral axis 192, and a longitudinal axis 193. The axes 191-193 are mutually perpendicular. Although the elevation axis 191 appears to extend in a vertical direction generally parallel to gravity, it is understood that the axes 191-193 are not required to have any particular orientation with respect to gravity. The dielectric waveguide 100 extends a length along the longitudinal axis 193 between two ends 104.

The dielectric waveguide 100 includes a cladding member 102 that extends the length of the dielectric waveguide 100. The cladding member 102 defines at least a portion of each of the ends 104 of the waveguide 100. The cladding member 102 is formed of a dielectric material, referred to herein as an intermediate dielectric material. As used herein, dielectric materials are electrical insulators that may be polarized by an applied electric field. The cladding member 102 defines a core region 114 that extends through the cladding member 102 for the length of the cladding member 102 between the two ends 104. The core region 114 includes an opening 116 at both ends 104 of the cladding member 102. The core region 114 is filled with a dielectric material, referred to herein as a central dielectric material. The central dielectric material is different than the intermediate dielectric material of the cladding member 102. The central dielectric material has a dielectric constant value that is different from a dielectric constant value of the intermediate dielectric material. In an exemplary embodiment, the dielectric constant value (or dielectric constant) of the central dielectric material within the core region 114 is less than the dielectric constant of the intermediate dielectric material of the cladding member 102.

The respective dielectric constants of the central dielectric material and the intermediate dielectric material affect the distribution of an electric field within the waveguide 100 between the core region 114 and the cladding member 102 surrounding the core region 114. Generally, an electric field through a dielectric waveguide concentrates within the material that has the greater dielectric constant, at least for dielectric materials having dielectric constants in the range of 0-15. As stated above, the dielectric constant of the intermediate dielectric material of the dielectric waveguide 100 is greater than the dielectric constant of the central dielectric material. Therefore, a majority of the electric field is distributed within the cladding member 102 (such that the field strength is greatest within the cladding member 102), although minor portions of the electric field may be distributed within the core region 114 and/or outside of the cladding member 102.

The dielectric waveguide 100 also includes a jacket member 126 that engages and surrounds the cladding member 102 along the length of the cladding member 102. The jacket member 126 may be disposed on an outer surface of the cladding member 102. The jacket member 126 surrounds the cladding member 102 such that the jacket member 126 extends around the periphery of the cladding member 102. The jacket member 126 defines the outer surface of the dielectric waveguide 100 between the ends 104. The jacket member 126 is formed of an outer dielectric material. In an exemplary embodiment, the outer dielectric material has a dielectric constant that is less than the dielectric constant of the intermediate dielectric material of the cladding member 102. Therefore, the intermediate dielectric material of the cladding member 102 has a greater dielectric constant than both the outer dielectric material of the jacket member 126 and the central dielectric material within the core region 114. As a result, the electric field through the dielectric waveguide 100 may be concentrated within the cladding member 102 with smaller or residual portions of the field extending within the core region 114 and/or the jacket member 126.

Since the cladding member 102, in which the electric field is concentrated, is spaced apart from the outer boundary of the dielectric waveguide 100 by the surrounding jacket member 126, the electric field at the outer boundary of the waveguide 100 and external to the waveguide 100 is weak or non-existent. For example, since most of the electric field is concentrated within the cladding member 102, the jacket member 126 acts as a buffer layer between the electromagnetic energy within the cladding member 102 and the outer boundary of the waveguide 100. Due to the jacket member 126, very little, if any, of the field is present at the outer boundary of the waveguide 100 or external of the waveguide 100. The dielectric waveguide 100 is therefore relatively protected from issues related to portions of the field being external to the waveguide 100, including disturbances in the electrical field caused by external objects physically engaging the waveguide 100, crosstalk caused by proximity of multiple waveguides 100 in a bundle, and energy loss due to radiating fields along bends in the waveguide 100.

The dielectric waveguide 100 in one or more embodiments described herein includes a central dielectric material (within the core region 114), an intermediate dielectric material (within the cladding member 102) surrounding the central dielectric material, and an outer dielectric material (within the jacket member 126) surrounding the intermediate dielectric material. As described above, the intermediate dielectric material defining a middle layer of the waveguide 100 may have a higher dielectric constant than both the central dielectric material and the outer dielectric material on either side thereof. The dielectric waveguide 100 may be referred to as a tightly coupled waveguide 100 because the electric field is concentrated within the cladding member 102 that defines the middle layer and little, if any, of the field is at the external boundary of the waveguide 100 or outside of the waveguide 100. Since the dielectric constant of the middle dielectric layer is greater than the dielectric constants of the materials on either side thereof, the dielectric waveguide 100 may be referred to as having a low-high-low configuration. Each "low" represents the dielectric constant of the central dielectric material or the outer dielectric material, and the "high" represents the dielectric constant of the intermediate dielectric material relative to the dielectric constants of the central and outer dielectric materials.

Figure 2:
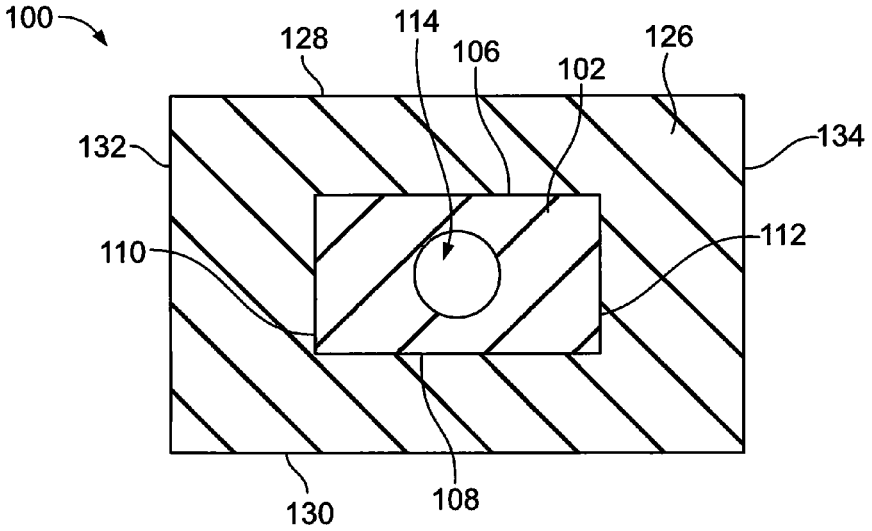
FIG. 2 is a cross-sectional view of the dielectric waveguide according to a first embodiment.

FIG. 2 is a cross-sectional view of the dielectric waveguide 100 according to a first embodiment. The cross-section is taken along a plane defined by the vertical and lateral axes 191, 192 (shown in FIG. 1). In the illustrated embodiment, the core region 114 defined by the cladding member 102 is filled with air, which is the central dielectric material. Thus, the core region 114 is filled with a dielectric material in a gas phase instead of a solid phase. Air has a dielectric constant that is approximately 1. The intermediate dielectric material of the cladding member 102 has a dielectric constant that is greater than the dielectric constant of air. For example, the intermediate dielectric material may have a dielectric constant between 2 and 15. More specifically, the intermediate dielectric material may have a dielectric constant between 3 and 7. As used herein, a range that is "between" two end values is meant to be inclusive of the end values. In an embodiment, the dielectric constant value of the intermediate dielectric material may be between 3 and 5 such that the difference between the dielectric constant of the air within the core region 114 and the dielectric constant of the cladding member 102 is between 2 and 4. Due to a relatively small difference between the dielectric constant values, the field strength of the electric field may be distributed within both the cladding member 102 and the core region 114, although the majority of the field strength concentrates in the cladding member 102.

The intermediate dielectric material of the cladding member 102 may be a dielectric polymer, such as a plastic or another synthetic polymer. For example, the intermediate dielectric material may be polypropylene, polyethylene, polytetrafluoroethylene (PTFE), polystyrene, a polyimide, a polyamide, or the like. Optionally, the intermediate dielectric material may be a composition or mixture of more than one such polymer. The use of such polymers may reduce loss through the dielectric waveguide 100, allowing signals to propagate farther than other waveguide materials. In other embodiments, the intermediate dielectric material may be or include paper, mica, rubber, salt, concrete, Neoprene synthetic rubber, Pyrex® borosilicate glass, silicon dioxide, or the like. The cladding member 102 may be flexible or semi-rigid.

In an embodiment, at least one of the cladding member 102 or the core region 114 of the cladding member 102 has an oblong cross-sectional shape. As used herein, "oblong" means that the respective component or space is longer in one direction than in another direction, such that the component or space is not circular or square. The oblong shape of the cladding member 102 and/or core region 114 may orient the electromagnetic waves in the dielectric waveguide 100 in a horizontal or vertical polarization. The cladding member 102 and/or core region 114 that has the oblong shape may be rectangular with right angle corners, rectangular with curved corners, trapezoidal, elliptical, oval, or the like.

In the illustrated embodiment in FIG. 2, the cladding member 102 has an oblong cross-sectional shape, and the core region 114 has a circular cross-sectional shape. The cladding member 102 has a top side 106, a bottom side 108, a left side 110, and a right side 112. As used herein, relative or spatial terms such as "first," "second," "top," "bottom," "left," and "right" are only used to distinguish the referenced elements and do not necessarily require particular positions, orders, or orientations in the dielectric waveguide 100 or in the surrounding environment of the dielectric waveguide 100. The cross-sectional shape of the cladding member 102 is oblong such that the cladding member 102 is longer in one direction than in another direction. In the illustrated embodiment, the top side 106 and the bottom side 108 of the cladding member 102 are longer than the left side 110 and the right side 112. As such, the cladding member 102 has a width, extending between the left and right sides 110, 112, that is greater than a height of the cladding member 102, which extends between the top and bottom sides 106, 108. The polarization of the electromagnetic waves through the waveguide 100, such as whether the waves are oriented horizontally or vertically, may be based on the width of the cladding member 102 being greater than the height.

In the illustrated embodiment, the cladding member 102 is rectangular. For example, the top side 106 is parallel to the bottom side 108, the left side 110 is parallel to the right side 112, and the cladding member 102 defines right angles between adjacent sides 106, 108, 110, 112. The adjacent sides 106, 108, 110, 112 intersect one another at right angle corners. Each of the sides 106, 108, 110, 112 is planar. The cladding member 102 in FIG. 2 thus includes two pairs of opposing planar sides, where the first pair is the top and bottom sides 106, 108 and the second pair is the left and right sides 110, 112. The cladding member 102 may have various dimensions. In an embodiment, the cladding member 102 has a height of approximately 0.8 mm and a width of approximately 1.2 mm. The aspect ratio for the width of the cladding member 102 to the height is less than two in an embodiment, but may be at least two in other embodiments. In an alternative embodiment, the cladding member 102 may have another oblong shape, such as a rectangle with rounded corners, a trapezoid, an ellipse, an oval with two planar sides, or the like. For example, in some alternative embodiments, the cladding member 102 may include only one pair of opposing planar sides which orients the electromagnetic waves within the dielectric waveguide 100. The core region 114 may have various sizes relative to the cladding member 102. In an embodiment, the diameter (such as 0.4 mm) of the circular core region 114 is approximately half of the height of the cladding member 102, and the core region 114 is located centrally relative to the sides 106, 108, 110, 112 of the cladding member 102. In another alternative embodiment, the core region 114 may have an oblong cross-sectional shape instead of, or in addition to, the cladding member 102 having an oblong cross-sectional shape.

The outer dielectric material of the jacket member 126 may be a dielectric polymer, such as a plastic or another synthetic polymer. For example, the outer dielectric material may be polypropylene, polyethylene, polytetrafluoroethylene (PTFE), polystyrene, a polyimide, a polyamide, or the like, including combinations thereof. The jacket member 126 may be flexible or semi-rigid. The outer dielectric material is a different material than the intermediate dielectric material and has a lower dielectric constant than the intermediate dielectric material. For example, the dielectric constant of the outer dielectric material may be less than 5, such as between 1.5 and 3.5 or, more specifically, between 2 and 3. The outer dielectric material of the jacket member 126 has a dielectric constant that is greater than, less than, or equal to the central dielectric material within the core region 114 of the cladding member 102. The outer dielectric material may be the same as the central dielectric material, or, alternatively, the jacket member 126 may be formed of a different material than the material that fills the core region 114.

In an embodiment, the jacket member 126 includes at least one planar outer surface. The planar surface is configured to be used as a reference surface for aligning the jacket member 126 in an interconnection. For example, the reference surface is used for mechanically aligning the dielectric waveguide 100 with a connecting waveguide (not shown), a connector, an antenna, or another electrical component. When the waveguide 100 is being connected at one of the ends 104 (shown in FIG. 1) to a corresponding end of a connecting waveguide to form a butt joint, each reference surface of the waveguide 100 is able to be aligned with a complementary planar surface of the connecting waveguide to ensure that the cladding member 102 and the core region 114 align with respective cladding and core parts of the connecting waveguide. If cladding member 102 and the core region 114 do not align properly with the cladding and core parts, respectively, of the connecting waveguide (such that the oblong cladding member 102 is oriented horizontally while the cladding of the connecting waveguide is oriented vertically), at least some of the electromagnetic waves will not be transmitted across the interface between the two waveguides. For example, the electromagnetic waves leaving the transmitting waveguide may reflect at the interface or otherwise radiate away instead of being received within the receiving waveguide for further propagation along the signal path.

In the illustrated embodiment, the jacket member 126 includes four sides including a top side 128, a bottom side 130, a left side 132, and a right side 134. Each of the sides 128, 130, 132, 134 has a planar surface in the illustrated embodiment, such that each of the sides 128, 130, 132, 134 may be used as a reference surface used to align the dielectric waveguide 100 in an interconnection. The top and bottom sides 128, 130 align with the top and bottom sides 106, 108 of the cladding member 102 such that the sides 128, 130 are parallel to the sides 106, 108. In addition, the left and right sides 132, 134 align with the left and right sides 110, 112 of the cladding member 102 such that the sides 132, 134 are parallel to the sides 110, 112. Although the jacket member 126 may obstruct the view of the cladding member 102 surrounded by the jacket member 126, when connecting the dielectric waveguide 100 to an identical connecting waveguide, an operator or a machine may align the two waveguides by aligning the jacket member 126 of the waveguide 100 with the outer jacket of the connecting waveguide. For example, the jackets are aligned by aligning the top side 128 of the jacket member 126 with the corresponding top side of the outer jacket of the connecting waveguide such that the two sides define a continuous plane when in abutment. Aligning the jackets aligns the cladding member 102 within the waveguide 100 with the cladding of the connecting waveguide. As a result, the polarized electromagnetic waves through the dielectric waveguide 100 are readily received across the interface and into the connecting waveguide without being reflected back into the transmitting dielectric waveguide 100.

In the illustrated embodiment, the jacket member 126 has an oblong cross-sectional shape. More specifically, the jacket member 126 is rectangular with right angle corners. The top and bottom sides 128, 130 of the jacket member 126 are longer than the left and right sides 132, 134. In an embodiment, the jacket member 126 has a cross-sectional area, defined by an outer perimeter of the jacket member 126, that is at least three times greater than a cross-sectional area of the cladding member 102 that is defined by the outer perimeter of the cladding member 102. For example, if the height of the cladding member 102 is 1 mm and the width is 1.5 mm, the cross-sectional area of the cladding member 102 is 1.5 $mm^2$ and the cross-sectional area of the jacket member 126 surrounding the cladding member 102 is at least 4.5 $mm^2$. The dimensions of the jacket member 126 may include a height of 2 mm and a width of 2.5 mm, for example, which yields a cross-sectional area greater than 4.5 $mm^2$. In an embodiment, the cladding member 102 within the jacket member 126 is spaced apart from each of the four sides 128, 130, 132, 134 of the jacket member 126 by at least a designated threshold distance such that the outer dielectric material provides a buffer between the cladding member 102 and the outer boundary of the waveguide 100. For example, the cladding member 102 may be at least 0.5 mm away from each of the four sides 128, 130, 132, 134 of the jacket member 126. Although the jacket member 126 is shown and described in FIG. 2 as being rectangular with right angle corners, in an alternative embodiment, the jacket member 126 may be circular, square, or have a different oblong shape, such as a rectangle with curved corners, an ellipse, an oval, a trapezoid, or the like.

The dielectric waveguide 100 may be fabricated using standard manufacturing processes and/or techniques, such as by extrusion, drawing, fusing, molding, or the like. In one example, the intermediate dielectric material and the outer dielectric material are co-extruded such that the cladding member 102 and the jacket member 126 are formed simultaneously. Alternatively, the cladding member 102 may be pre-formed and the outer dielectric material may be extruded, molded, drawn, or the like, over the cladding member 102 to form the jacket 126 around the cladding member 102.

Figure 3:
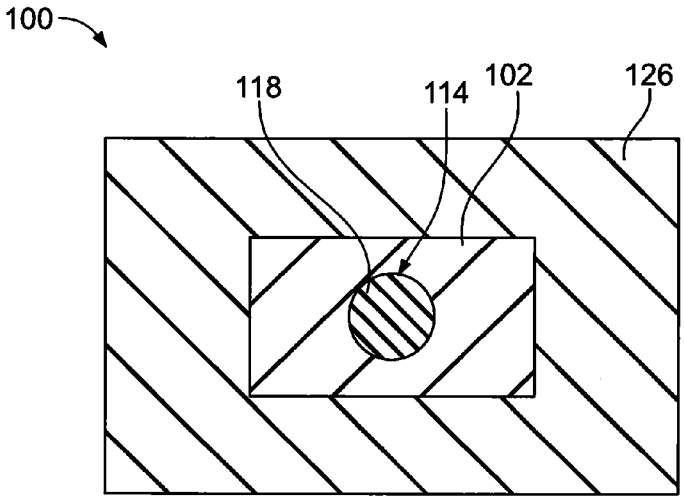
FIG. 3 is a cross-sectional view of the dielectric waveguide according to a second embodiment.

FIG. 3 is a cross-sectional view of the dielectric waveguide 100 according to a second embodiment. In the embodiment shown in FIG. 3, the dielectric waveguide 100 includes a core member 118 within the core region 114 of the cladding member 102. The core member 118 extends the length of the dielectric waveguide 100 between the two ends 104 (shown in FIG. 1). The core member 118 fills the core region 114 such that no clearances or gaps exist between an outer surface of the core member 118 and an inner surface of the cladding member 102. The cladding member 102 engages and surrounds the core member 118 along the length of the core member 118. The core member 118 has a circular cross-sectional shape, defined by the circular shape of the core region 114. In an alternative embodiment, the core member 118 may have an oblong cross-sectional shape. For example, at least one of the core member 118 and the cladding member 102 has an oblong shape in one or more embodiments described herein. The dielectric material of the core member 118 is referred to as "central" because the dielectric material is central relative to a longitudinal axis through the core member 118. The dielectric materials of the cladding member 102 and the jacket member 126 are referred to as being "intermediate" and "outer," respectively, due to the radial locations of these layers relative to the central dielectric material and the axis through the core member 118.

The core member 118 is formed of at least one dielectric polymer that defines the central dielectric material. The central dielectric material is in the solid phase, as opposed to the air described in FIG. 2. For example, the central dielectric material of the core member 118 may be polypropylene, polyethylene, PTFE, polystyrene, a polyimide, a polyamide, or the like, including combinations thereof. The central dielectric material is different than the intermediate dielectric material of the cladding member 102 and has a lower dielectric constant than the intermediate dielectric material. For example, the dielectric constant of the central dielectric material may be less than 5, such as between 1.5 and 3.5 or, more specifically, between 2 and 3. The central dielectric material of the core member 118 may be the same as, or different than, the outer dielectric material of the jacket member 126. The dielectric constant of the central dielectric material may be greater than, less than, or equal to, the dielectric constant of the outer dielectric material. The dielectric waveguide 100 shown in FIG. 3 may be fabricated by extrusion, drawing, molding, fusing, or the like. For example, the core member 118, the cladding member 102, and the jacket member 126 may be co-extruded simultaneously or may be formed at different times.

Figure 4:
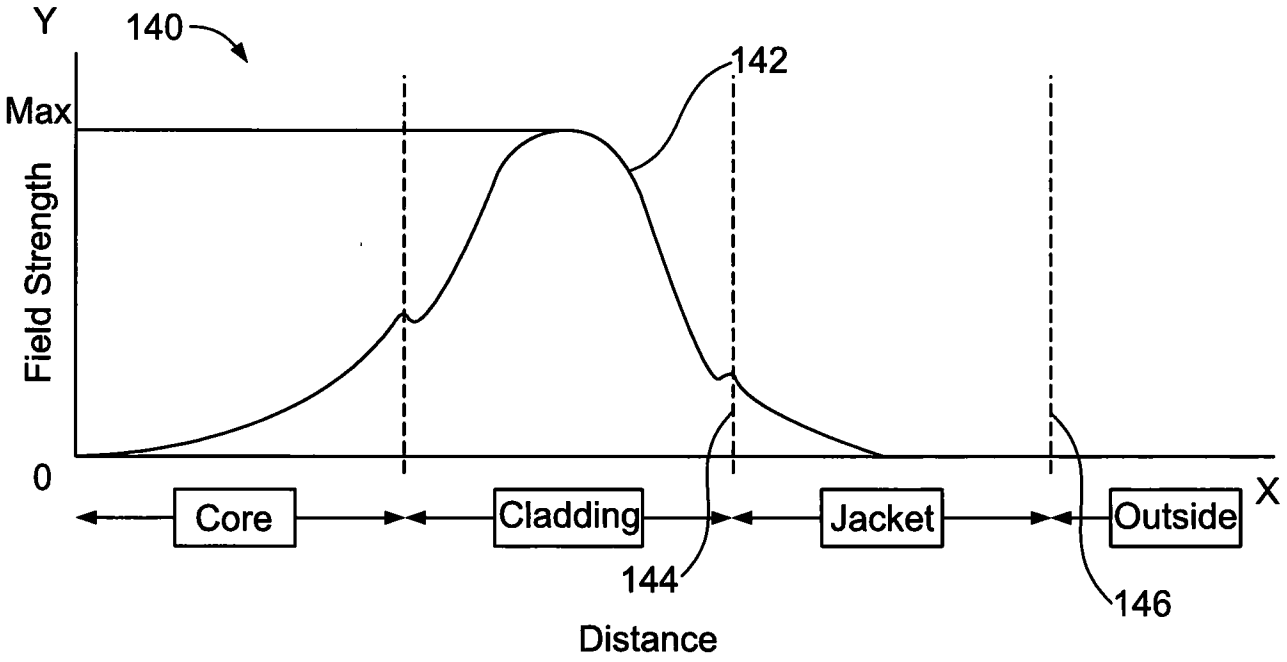
FIG. 4 is a plot illustrating field strength across a distance of the dielectric waveguide according to an embodiment.

FIG. 4 is a plot 140 illustrating field strength (i.e. Y axis) across a distance (i.e. X axis) of the dielectric waveguide 100 according to an embodiment. The distance extends radially from a center (i.e. 0) of the core member 118 (or the center of the core region 114) shown in FIG. 3 through the cladding member 102 and then the jacket member 126 and eventually beyond the boundary of the waveguide 100 into the external "outside" environment. The widths of the individual sections of the waveguide 100 represented along the X axis of the plot 140 are not meant to represent the actual widths of the core, cladding, and jacket members 118, 102, 126, but only to illustrate the configuration of the members 118, 102, 126 within the waveguide 100.

In an example embodiment of the waveguide 100, the central dielectric material of the core member 118 and the outer dielectric material of the jacket member 126 are both dielectric polymers. The central dielectric material and the outer dielectric material each include at least one of polypropylene, polyethylene, PTFE, or polystyrene. The dielectric constants of the central dielectric material and the outer dielectric material are both less than 3. The central and outer dielectric materials may be the same or different materials. The intermediate dielectric material of the cladding member 102 has a dielectric constant that is greater than the dielectric constants of the central and outer dielectric materials, such as in the range of 3-12, or between 3 and 7. For example, the intermediate dielectric material may be nylon, having a dielectric constant of 5. The central dielectric material may be polypropylene, having a dielectric constant around 2.3, and the outer dielectric material may be PTFE, having a dielectric constant of 2.1. As such, the dielectric waveguide 100 in this example is a tightly coupled waveguide having a low-high-low configuration of dielectric layers.

In FIG. 4, the waveguide represented by plot line 142 has a core dielectric constant of 2.3, a cladding dielectric constant of 5, and a jacket dielectric constant of 2.1. The dielectric constant of the air outside of the waveguide 100 is 1. As shown in the plot 140, the field strength is greatest (i.e. Max) in the cladding member 102, which has the largest dielectric constant. Minor portions of the electric field are dispersed within the core member 118 and the jacket member 126. Since the dielectric constant value of the central dielectric material of the core member 118 is greater than the outer dielectric material of the jacket member 126, although not significantly greater, more of the field may be within the core member 118 than the jacket member 126. Although some of the electric field is located within the jacket member 126, the portion of the field within the jacket member 126 is concentrated along the interface 144 between the cladding member 102 and the jacket member 126. As shown in the plot 140, the portion of the electric field within the jacket member 126 does not extend to the outer boundary 146 between the jacket member 126 and the outside environment. Thus, the dielectric waveguide 100 may be relatively protected against inter-signal interference, cross-talk, energy loss around bends, and interference due to external physical influences, which may be caused by portions of the electric field being dispersed at the boundary 146 or even outside of the waveguide 100.

Figure 5:
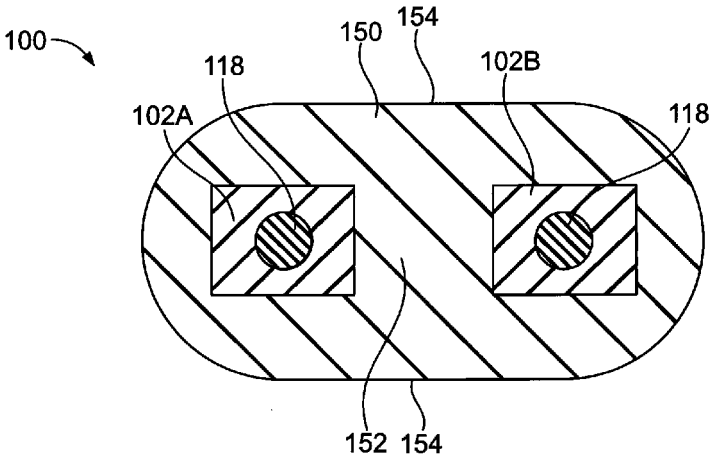
FIG. 5 is a cross-sectional view of the dielectric waveguide according to an alternative embodiment.

FIG. 5 is a cross-sectional view of the dielectric waveguide 100 according to an alternative embodiment. In the illustrated embodiment, the waveguide 100 includes a first cladding member 102A and a second cladding member 102B. The two cladding members 102A, 102B may be identical or at least substantially similar to each other. The two cladding members 102A, 102B may each be identical or at least substantially similar to the cladding member 102 shown in FIG. 3. For example, each cladding member 102 has an oblong cross-sectional shape and surrounds a respective core member 118. The waveguide 100 includes a jacket member 150 that surrounds and engages each of the cladding members 102A, 102B. For example, the jacket member 150 is a single body that collectively surrounds both of the cladding members 102A, 102B and extends between the cladding members 102A, 102B. The cladding members 102A, 102B are spaced apart from one another by an intervening portion 152 of the jacket member 150. The jacket member 150 in the illustrated embodiment has an oblong cross-sectional shape that is an oval having two parallel planar sides 154. As described above, the waveguide 100 shown in FIG. 5 may be a tightly coupled waveguide such that the dielectric constants of the intermediate dielectric material(s) of the cladding members 102A, 102B are greater than the dielectric constants of both the outer dielectric material of the jacket member 150 and the central dielectric materials of the respective core members 118.

Figure 6:
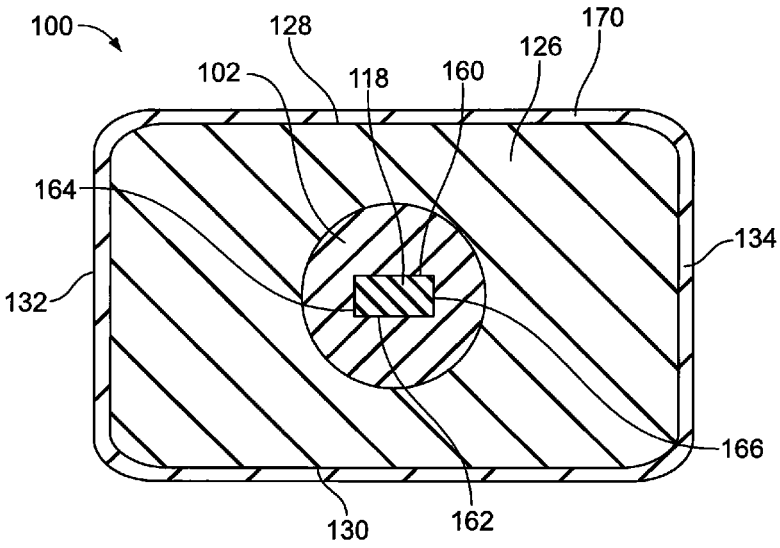
FIG. 6 is a cross-sectional view of the dielectric waveguide according to another alternative embodiment.

FIG. 6 is a cross-sectional view of the dielectric waveguide 100 according to another alternative embodiment. The components of the dielectric waveguide 100, including the core member 118, the cladding member 102, and the jacket member 126 have different cross-sectional shapes in the embodiment shown in FIG. 6 than the embodiment shown in FIG. 3. For example, the core member 118 is oblong, having a rectangular shape with right angle corners. The cladding member 102 is circular. The jacket member 126 is oblong, having a rectangular shape with rounded corners. The top and bottom sides 128, 130 of the jacket member 126 are longer than the left and right sides 132, 134. Likewise, a top side 160 and a bottom side 162 of the rectangular core member 118 are longer than a left side 164 and a right side 166 of the core member 118. The top and bottom sides 128, 130 of the jacket member 126 align with and are parallel to the top and bottom sides 160, 162 of the core member 118, which allows the sides 128, 130, 132, 134 of the jacket member 126 to be used as reference surfaces for aligning the waveguide 100 in an interconnection. The core member 118, the cladding member 102, and the jacket member 126 of the embodiment shown in FIG. 6 may be formed of the same dielectric materials and in the same low-high-low configuration as described with reference to the embodiments shown in FIGS. 2 and 3.

Optionally, the dielectric waveguide 100 may include a shield layer 170 that engages and surrounds the jacket member 126. The shield layer 170 is electrically conductive, and is configured to reduce signal degradation caused by electromagnetic interference. The shield layer 170 may extend the length of the jacket member 126. Although the shield layer 170 around the perimeter of the jacket member 126 is electrically conductive, since the electric field within the waveguide 100 is concentrated within the cladding member 102, the conductive shield layer 170 is spaced apart from the field concentration such that the shield layer 170 has a negligible effect, if at all, on the electromagnetic signal propagation properties of the waveguide 100. The buffer between the field concentration and the shield layer 170 prohibits electrical energy loss, hard cut-off frequencies, and other undesirable effects associated with a conductive material interacting with the electric field.

The shield layer 170 may be formed of one or more metals, such as copper, aluminum, silver, or the like. Alternatively, the shield layer 170 may be a conductive polymer that includes metal particles dispersed within a dielectric polymer. The shield layer 170 may be a metal foil, a metallized composite heat shrink tubing, a conductive tape (for example, carbon nanotube tape), a lossy conductive polymer overmold, or the like. For example, the shield layer 170 may be applied around the jacket member 126 through various techniques and/or processes, including electroplating, wrapping, heat shrinking, physical vapor deposition (PVD), molding, or the like.

Figure 7:
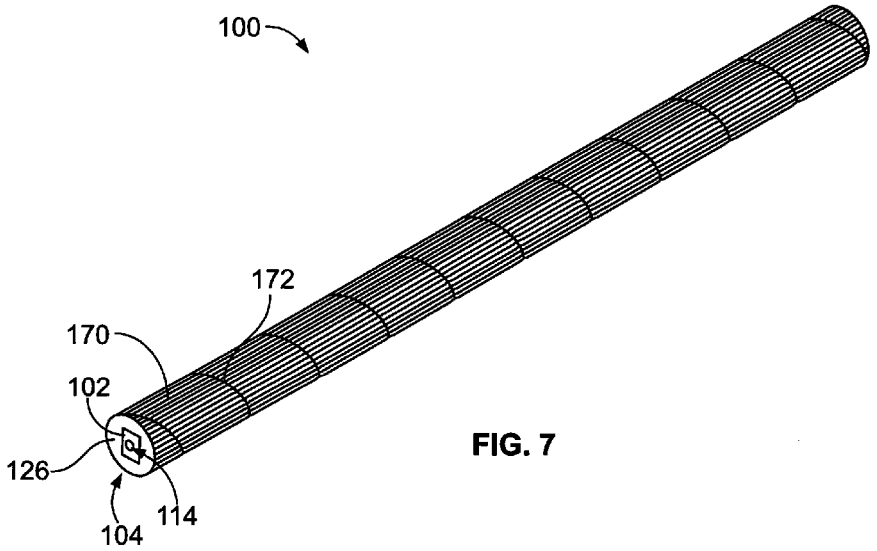
FIG. 7 is a top perspective view of a dielectric waveguide formed in accordance with an alternative embodiment.

FIG. 7 is a top perspective view of a dielectric waveguide 100 formed in accordance with an alternative embodiment. The dielectric waveguide 100 includes a cladding member 102 that defines a core region 114, a jacket member 126 surrounding the cladding member 102, and a shield layer 170 surrounding the jacket member 126. The core region 114 may be filled with air or a core member 118 (shown in FIG. 3) formed of a dielectric polymer. The core region 114 has a circular cross-sectional shape, the cladding member 102 has an oblong, rectangular cross-sectional shape, and the jacket member 126 has a circular cross-sectional shape. Since the jacket member 126 is circular, in order to align the dielectric waveguide 100 with a connecting waveguide, a segment of the jacket 126 at one of the ends 104 may be stripped or otherwise removed to expose the oblong cladding member 102. A planar side of the exposed cladding member 102 may be used as a reference surface to align the waveguide 100 with the connecting waveguide. In the illustrated embodiment, the shield layer 170 is a metal foil that is spiral-wrapped along the perimeter of the jacket member 126 along the length of the jacket member 126, defining a helical seam 172. The foil may be wrapped using other techniques, such as cigarette-wrapping, in other embodiments.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A dielectric waveguide for propagating electromagnetic signals, the dielectric waveguide comprising:

a cladding member extending a length between two ends, the cladding member being formed of an intermediate dielectric material, the cladding member defining a core region that extends along the length of the cladding member, the core region being filled with a central dielectric material having a dielectric constant value that is less than a dielectric constant value of the intermediate dielectric material of the cladding member; and a jacket member engaging and surrounding the cladding member along the length of the cladding member, the jacket member being formed of an outer dielectric material having a dielectric constant value that is less than the dielectric constant value of the intermediate dielectric material of the cladding member, wherein the outer dielectric material of the jacket member is a dielectric polymer.

2. The dielectric waveguide of claim 1, wherein the central dielectric material that fills the core region is air.

3. The dielectric waveguide of claim 1, wherein the central dielectric material that fills the core region is a dielectric polymer.

4. The dielectric waveguide of claim 3, wherein the central dielectric material that fills the core region is different from the outer dielectric material of the jacket member.

5. The dielectric waveguide of claim 1, wherein at least one of the core region and the cladding member has an oblong cross-sectional shape.

6. The dielectric waveguide of claim 1, wherein the jacket member has an oblong cross-sectional shape.

7. The dielectric waveguide of claim 1, wherein the jacket member has at least one planar outer surface.

8. The dielectric waveguide of claim 1, wherein the jacket member has a cross-sectional area that is at least three times greater than a cross-sectional area defined by an outer perimeter of the cladding member.

9. The dielectric waveguide of claim 1, wherein the dielectric constant value of the cladding member is between 3 and 7.

10. The dielectric waveguide of claim 1, further comprising an electrically conductive shield layer engaging and surrounding the jacket member along a length of the jacket member.

11. The dielectric waveguide of claim 1, wherein the cladding member is a first cladding member that extends along a first axis, the dielectric waveguide further comprising a second cladding member extending along a different, second axis such that the second cladding member is spaced apart from the first cladding member, the jacket member surrounding both the first and second cladding members and extending between the first and second cladding members.

12. A dielectric waveguide for propagating electromagnetic signals, the dielectric waveguide comprising:

a core member extending a length between two ends, the core member being formed of a central dielectric material that is solid;

a cladding member engaging and surrounding the core member along the length of the core member, the cladding member being formed of an intermediate dielectric material having a dielectric constant value that is greater than a dielectric constant value of the central dielectric material of the core member; and a jacket member engaging and surrounding the cladding member along a length of the cladding member, the jacket member being formed of an outer dielectric material having a dielectric constant value that is less than the dielectric constant value of the intermediate dielectric material of the cladding member.

13. The dielectric waveguide of claim 12, wherein the central dielectric material of the core member and the outer dielectric material of the jacket member are both dielectric polymers.

14. The dielectric waveguide of claim 12, wherein the central dielectric material of the core member and the outer dielectric material of the jacket layer each include at least one of polypropylene, polyethylene, polytetrafluoroethylene (PTFE), or polystyrene.

15. The dielectric waveguide of claim 12, wherein the jacket member has a cross-sectional area that is at least three times greater than a cross-sectional area defined by an outer perimeter of the cladding member.

16. The dielectric waveguide of claim 12, wherein the dielectric constant values of the central dielectric material of the core member and the outer dielectric material of the jacket member are each less than 3 and the dielectric constant value of the intermediate dielectric material of the cladding member is between 3 and 7.

17. The dielectric waveguide of claim 12, wherein at least one of the core member and the cladding member has an oblong cross-sectional shape.

18. The dielectric waveguide of claim 12, further comprising an electrically conductive shield layer engaging and surrounding the jacket member along a length of the jacket member.

19. The dielectric waveguide of claim 12, wherein the jacket member has at least one planar outer surface.

20. A dielectric waveguide for propagating electromagnetic signals, the dielectric waveguide comprising:

a cladding member extending a length between two ends, the cladding member being formed of an intermediate dielectric material that has a dielectric constant value between 3 and 7, the cladding member defining a core region that extends along the length of the cladding member, the core region being filled with a central dielectric material having a dielectric constant value that is less than the dielectric constant value of the intermediate dielectric material of the cladding member; and a jacket member engaging and surrounding the cladding member along the length of the cladding member, the jacket member being formed of an outer dielectric material having a dielectric constant value that is less than the dielectric constant value of the intermediate dielectric material of the cladding member.

* * * * *